US006601403B1

(12) United States Patent
Roth et al.

(10) Patent No.: US 6,601,403 B1
(45) Date of Patent: Aug. 5, 2003

(54) THERMAL STORAGE LID

(76) Inventors: Henry Roth, 42 Tremont St., Duxbury, MA (US) 02332; Donna Roth, 42 Tremont St., Duxbury, MA (US) 02332

( * ) Notice: Subject to any disclaimer, the term of this patent is extended or adjusted under 35 U.S.C. 154(b) by 0 days.

(21) Appl. No.: 10/236,266

(22) Filed: Sep. 6, 2002

(51) Int. Cl.[7] ..... F25D 3/08; F17C 13/00
(52) U.S. Cl. ..... 62/457.2; 62/530; 62/371
(58) Field of Search ..... 62/457.2, 457.7, 62/530, 371

(56) References Cited

U.S. PATENT DOCUMENTS 2,024,648 A * 12/1935 Kissling ..... 62/388
4,024,731 A 5/1977 Branscum
4,065,336 A * 12/1977 Conklin ..... 156/69
4,249,392 A 2/1981 Hotta
4,570,454 A * 2/1986 Campbell ..... 62/457.3
5,177,981 A 1/1993 Haas
5,231,850 A * 8/1993 Morris ..... 62/457.6
5,568,735 A 10/1996 Newkirk et al.
5,701,757 A 12/1997 Heverly
5,711,164 A * 1/1998 Slack ..... 62/457.9
6,044,650 A * 4/2000 Cook et al. ..... 62/130
6,109,059 A * 8/2000 Lebrun ..... 62/457.5
6,318,114 B1 11/2001 Slaughter

* cited by examiner

*Primary Examiner*—William C. Doerrler
(74) *Attorney, Agent, or Firm*—Volpe and Koenig, P.C.

(57) ABSTRACT

A thermal energy storage lid for a container to heat or cool the container contents. The lid includes a first panel having an attachment element located around a periphery thereof, with the attachment element being adapted to engage a complementary container attachment element. A second panel is offset from the first panel, and has a peripheral edge connected to the first panel to form a compartment generally coextensive with the second panel. A thermal energy storage material located in the compartment.

19 Claims, 2 Drawing Sheets

FIG. 1
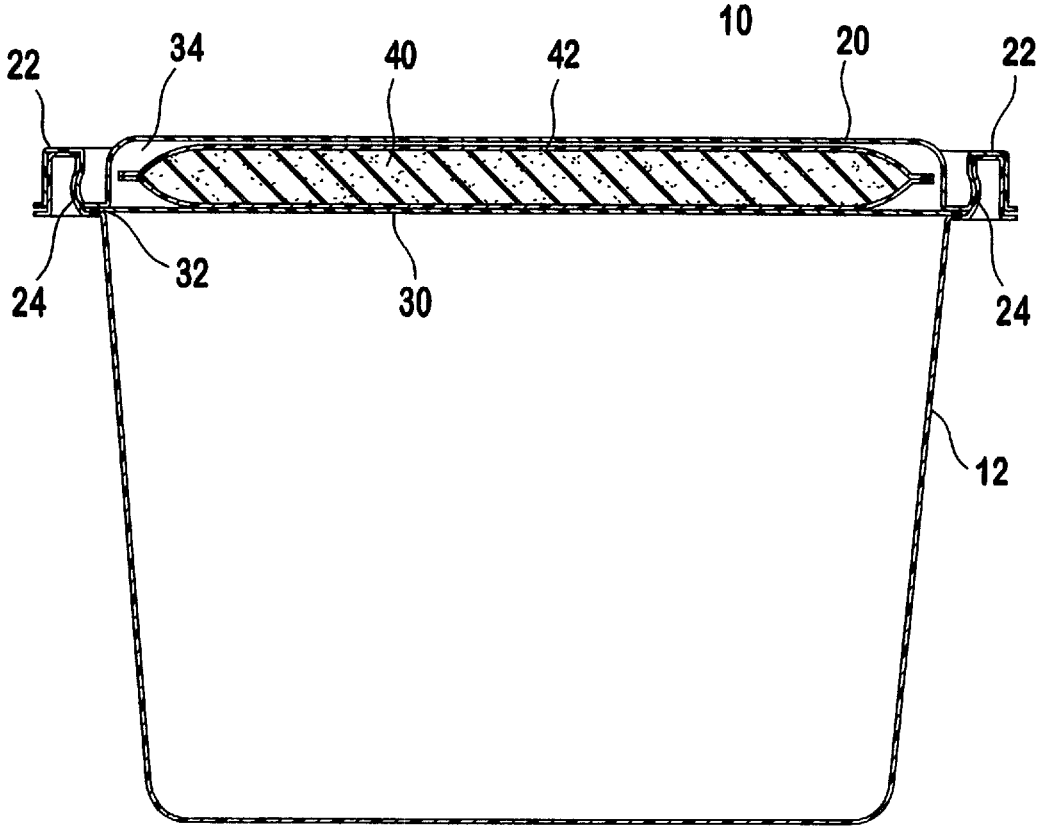
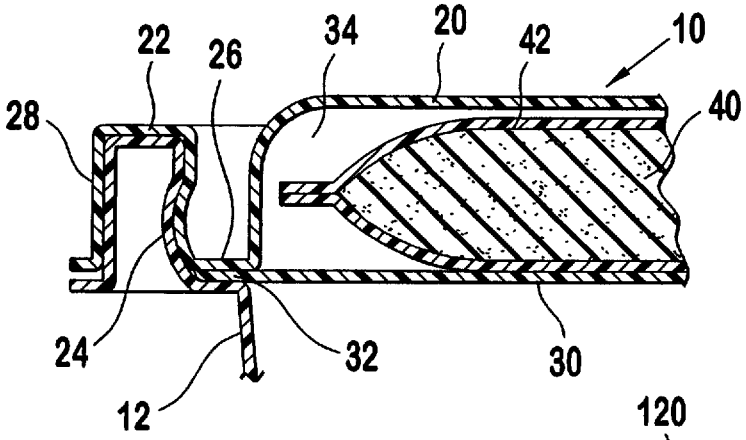
FIG. 2
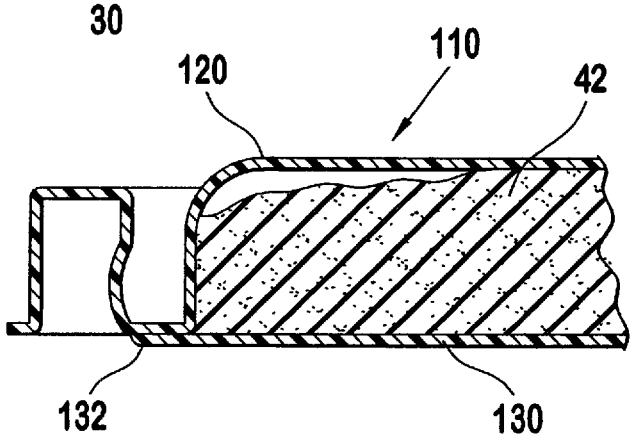
FIG. 4

THERMAL STORAGE LID

BACKGROUND

The present invention relates to a thermal storage lid for a storage container, and more particularly to a lid having a thermal energy storing material located therein.

Thermal energy storage packs are generally known for use in maintaining the contents of a storage container in a heated or cooled state. For example, frozen thermal packs are pre-filled with a thermal energy storage material which can be frozen and then placed in a thermal energy storage container, such as a cooler, in order to maintain the cooler contents such as food storage containers, in a cold state for a predetermined time period. Such thermal energy materials generally have 10–15 times the thermal capacity of frozen water and therefore maintain the cooler contents in a cold state for an extended period of time in comparison to ice alone. Such cold packs can be reused numerous times by refreezing them between use, and also avoid the problem of melting liquid contacting the items in the cooler. However, it is not always convenient to fit a cold pack in a cooler or other containers in addition to the various food storage containers placed therein.

Energy storage materials which maintain heat are also known which can be preheated in a microwave or through other means, and then placed in a thermal energy storage box in order to provide heat within the box to keep food storage containers in the box warm for a predetermined time period.

These heat or cold packs generally come in predetermined sizes which are not always suitable for use with a particular cooler or box, depending upon the articles or food storage containers also being placed therein.

SUMMARY

The present invention provides a thermal storage lid for a storage container. The lid includes a first panel having an attachment element located around a periphery thereof. The attachment element is adapted to engage a complementary container attachment element. A second panel is offset from the first panel and has a peripheral edge connected to the first panel to form a compartment generally coextensive with the second panel. A thermal storage material is located in the compartment.

In another aspect of the invention, the thermal storage lid is provided with a storage container to which the thermal storage lid is removably connected.

BRIEF DESCRIPTION OF THE DRAWINGS

The foregoing summary as well as the following detailed description of the preferred embodiments of the invention will be more easily understood if reviewed in conjunction with the appended drawings. In the drawings:

FIG. 1 is a cross-sectional view through a thermal storage lid in accordance with the invention located on a container.

FIG. 2 is a greatly enlarged detail, partially broken away, of the thermal storage lid of FIG. 1.

FIG. 4 is a greatly enlarged detail, similar to FIG. 2, of a second embodiment of a thermal storage lid.

DETAILED DESCRIPTION OF THE PREFERRED EMBODIMENTS

Figure 3:
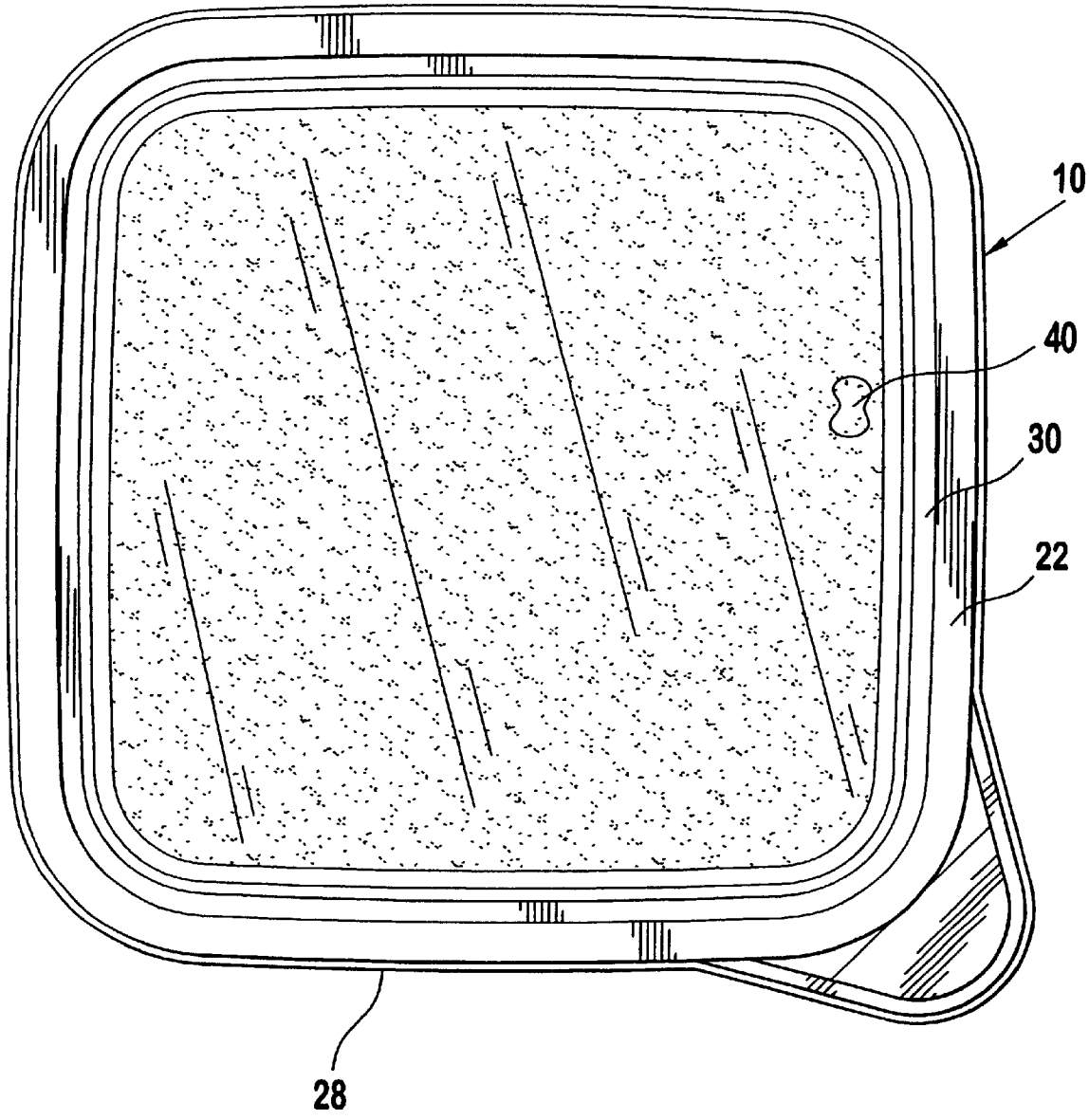
FIG. 3 is a bottom view of the thermal storage lid shown in FIG. 1.

Certain terminology is used in the following description for convenience only and is not considered limiting. The words "lower" and "upper" designate directions in the drawings to which reference is made. This terminology includes the words specifically noted above, derivatives thereof, and words of similar import. Additionally, the terms "a" and "one", as used in the claims and in the corresponding portions of the specification, are defined as including one or more of the referenced item unless specifically noted.

Referring now to FIGS. 1–3, a first embodiment of a thermal storage lid 10 for a container 12, which is preferably a food storage container, is shown. The lid 10 is preferably made of a polymeric material, such as PET, PVC, PPC or any other suitable material. The lid 10 includes a first panel 20 with an attachment element 22 located around a periphery thereof. The attachment element 22, which is shown in more detail in FIG. 2, is preferably a form locking connection which can be snapped into engagement with a complementary container attachment element 24. The attachment element 22 is preferably formed with a downwardly offset section 26 having an outwardly directed bump that can be engaged in a complementary recess in the container attachment element 24. This arrangement is a generally well known snap-type connection arrangement for food storage container lids. However, other suitable attachment elements may be utilized in accordance with the invention and the container can be of various and different types.

A second panel 30 is offset from the first panel 20 and includes a peripheral edge 32 which is connected to the first panel to form a compartment 34 generally coextensive with the second panel 30. Preferably, the second panel 30 is heat sealed to the offset portion 26 of the attachment element 22 of the first panel 20. However, other suitable connecting means, such as an adhesive or a solvent weld may also be utilized. Additionally, as shown in FIG. 2, the peripheral edge 32 of the second panel 30 faces toward a downwardly extending leg 28 around the periphery of the first panel 20 such that the peripheral edge 32 of the second panel 30 is not exposed during normal use. This results in a generally seamless appearance since the seam is generally out of any line of sight.

A thermal energy storage material 40 is located in the compartment 34. Preferably, the thermal energy storage material 40 is located in a sealed pouch 42 that is placed in the compartment 34 prior to sealing the second panel 30 to the first panel 20. The compartment 34 is preferably sealed to prevent the ingress of moisture or any other contaminants in order to allow the lid 10 to be easily cleaned for further use. Alternatively, the lid 10 may be provided as a disposable lid for use in connection with disposable containers.

In the preferred embodiment, the thermal energy storage material is in the form of a gel which can receive repeated cycles of freezing and thawing in order to provide a cold storage lid. Heat storing materials may also be utilized such that the lid can be placed in a microwave oven in order to heat the thermal energy storage material 40 prior to placing it on a container in order to keep the container contents warm.

In order to achieve a novel look, preferably the first and second panels are formed of transparent or translucent material so that the thermal energy storage material 40 can be seen. The thermal energy storage material may also be translucent or transparent in appearance. In addition, the thermal energy storage material and/or the pouch 42 in which it is located may be colored in any one of various colors. For example, for a cold storage thermal energy storing material 40, a blue color could be provided which may be translucent. For a hot material a red or pink transparent or translucent color could also be provided.

In use, the lid 10 is charged with thermal energy, such as by placing in a freezer in order to cool the thermal energy storage material 40 or by placing in a microwave and heating in order to charge the thermal energy storage material 40 with heat energy. The lid 10 is then snapped onto the container 12 by engaging the attachment element 22 located around the periphery of the lid 10 with the complementary attachment element 24 on the container 12. For cooling applications, the container 12 is cooled via heat energy from the container being absorbed by the thermal energy storage material 40 in order to maintain the contents of the container 12 in a cooled state. For heating applications, the thermal energy storage material 40 radiates heat which maintains the contents of the container 12 in a heated condition.

Referring now to FIG. 4, a second embodiment of the thermal energy storage lid 110 is shown. The lid 110 is similar to the lid 10 except that the energy storage material 142 is located directly between the first panel 120 and second panel 130 which is heat sealed around its periphery 132 to the first panel 120.

While the preferred embodiments of the invention have been described in detail, the invention is not limited to the specific embodiment described above, which should be considered as merely exemplary. Further modifications and extensions of the present invention may be developed and all such modifications are deemed to be within the scope of the present invention as defined by the appended claims.

What is claimed is:

1. A thermal energy storage lid for a container, comprising:

a first panel having an attachment element located around a periphery thereof, the attachment element having a generally U-shaped radial cross section defining a groove therein and being adapted to receive a complementary container attachment element within the groove in a snap fit fashion, the first panel generally having a first thickness;

a second panel, offset from the first panel, and having a peripheral edge connected to the first panel to form a compartment generally coextensive with the second panel, the second panel generally having a second thickness, the first and second thicknesses being generally the same;

a heat seal securing the first and second panels together in a non detachable fashion and sealing the compartment;

a sealed pouch disposed within the compartment;

a thermal energy storage material located in the sealed pouch.

2. The thermal energy storage lid of claim 1, wherein the second panel is sealed to an offset portion of the attachment element of the first panel.

3. The thermal energy storage lid of claim 2, wherein the peripheral edge of the second panel faces a downwardly extending leg located around a peripheral edge of the first panel.

4. The thermal energy storage lid of claim 1, wherein the thermal energy storage material is a gel.

5. The thermal energy storage lid of claim 1, wherein the first and second panels are formed of a transparent material.

6. The thermal energy storage lid of claim 5, wherein the thermal energy storage material is translucent.

7. The thermal energy storage lid of claim 5, wherein at least one of the thermal energy storage material, or the sealed pouch in which the thermal energy storage material is contained is colored.

8. The thermal energy storage lid of claim 1, wherein the thermal energy storage material has a volume that is between seventy-five (75%) percent and ninety (90%) percent of a volume of the compartment.

9. In combination, a thermal energy storage lid and a container to which the thermal energy storage lid is removably connected, the thermal energy storage lid comprising:

a first panel having an attachment element located around a periphery thereof, the attachment element having a generally U-shaped radial cross section defining a groove therein and being snap fit engageable with a container attachment element by receiving the container attachment element within the groove, the first panel generally having a first thickness;

a second panel, offset from the first panel, and having a peripheral edge connected to the first panel to form a compartment generally coextensive with the second panel, the second panel generally having a second thickness, the first and second thicknesses being generally the same;

the first and second panels being non detachably secured together;

a sealed pouch disposed within the compartment; and a thermal energy storage material located in the sealed pouch.

10. A thermal energy storage lid for a container, comprising a first panel having an attachment element located around a periphery thereof, the attachment element being adapted to engage a complementary container attachment element, the first panel being formed of transparent or translucent material, the first panel generally having a first thickness;

a second panel, offset from the first panel, and having a peripheral edge connected to the first panel to form a compartment generally coextensive with the second panel, the second panel being formed of transparent or translucent material, the second panel generally having a second thickness, the first and second thicknesses being generally the same;

a heat seal securing the first and second panels together in a non detachable fashion and sealing the compartment;

a sealed pouch disposed within the compartment; and a thermal energy storage material located in the sealed pouch.

11. The thermal energy storage lid of claim 10, wherein at least one of the thermal energy storage material or the sealed pouch in which the thermal energy storage material is contained is colored.

12. The thermal energy storage lid of claim 10, wherein the thermal energy storage material has a volume that is between seventy-five (75%) percent and ninety (90%) percent of a volume of the compartment.

13. A thermal energy storage lid for a container, comprising a first panel having an attachment element located around a periphery thereof, the attachment element being adapted to engage a complementary container attachment element, the first panel being formed of transparent or translucent material and generally having a first thickness;

a second panel offset from the first panel, and having a peripheral edge connected to the first panel to form a compartment generally coextensive with the second panel, the second panel being formed of transparent or translucent material and generally having a second thickness, the first and second thicknesses being generally the same;

a heat seal securing the first and second panels together in a non detachable fashion and sealing the compartment;

a sealed pouch disposed within the compartment; and a thermal energy storage material located in the sealed pouch, wherein at least one of the thermal energy storage material and the sealed pouch is colored.

14. The thermal energy storage lid of claim 13, wherein the thermal energy storage material has a volume that is between seventy five (75%) percent and ninety (90%) percent of a volume of the compartment.

15. A thermal energy storage lid for a container, comprising a first panel having an attachment element located around a periphery thereof, the attachment element having a generally U-shaped cross section defining a groove therein and being adapted to receive a container attachment element in a snap fit fashion within the groove;

a second panel, offset from the first panel, and having a peripheral edge connected to the first panel to form a compartment generally coextensive with the second panel;

the first and second panels being non detachably secured together;

a sealed pouch disposed within the compartment; and a thermal energy storage material located in the sealed pouch.

16. A snap fit thermal energy storage lid for a container, comprising a first panel having an attachment element located around a periphery thereof, the attachment element having a generally U-shaped radial cross-section defining a groove therein and being adapted to receive a container attachment element within the groove in a snap fit fashion, the first panel being formed of transparent or translucent material and generally having a first thickness;

a second panel, offset from the first panel, and having a peripheral edge connected to the first panel to form a compartment generally coextensive with the second panel, the second panel being formed of transparent or translucent material and generally having a second thickness, the first and second thicknesses being generally the same;

the first and second panels being non detachably secured together;

a sealed pouch disposed within the compartment; and a thermal energy storage material located in the sealed pouch, wherein the thermal energy storage material is colored.

17. The thermal energy storage lid of claim 16, wherein the first and second panels are secured together using a heat seal.

18. The thermal energy storage lid of claim 16, wherein the first and second panels are secured together using a weld.

19. The thermal energy storage lid of claim 18, wherein the weld is a solvent weld.

* * * * *

UNITED STATES PATENT AND TRADEMARK OFFICE

CERTIFICATE OF CORRECTION

PATENT NO. : 6,601,403 B1
APPLICATION NO. : 10/236266
DATED : August 5, 2003
INVENTOR(S) : Henry Roth et al.

It is certified that error appears in the above-identified patent and that said Letters Patent is hereby corrected as shown below:

On the Title Page, please add the following field:

Related U.S. Application Data

Item (60) Continuation-in-part of Application No. 29/165,211, filed Aug. 6, 2002, now Pat. No. D478,469.

Please add the following paragraphs above the "BACKGROUND" heading at col. 1, line 5:

CROSS REFERENCE TO RELATED APPLICATION

This application is a continuation-in-part of U.S. Design Patent Application Serial No. 29/165,211, filed on August 6, 2002 and issued as U.S. Design Patent No. D478,469 on August 19, 2003.

Signed and Sealed this
Fifteenth Day of February, 2011

David J. Kappos

David J. Kappos
*Director of the United States Patent and Trademark Office*